US007617859B2

(12) United States Patent
Auger

(10) Patent No.: US 7,617,859 B2
(45) **Date of Patent: *Nov. 17, 2009**

(54) ROLL UP COVERING FOR ARCHITECTURAL OPENINGS HAVING TOP DOWN/BOTTOM UP CAPABILITY

(75) Inventor: Raymond N. Auger, Aspen, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/067,300

(22) PCT Filed: Sep. 25, 2006

(86) PCT No.: PCT/US2006/037284

§ 371 (c)(1),
(2), (4) Date: Mar. 19, 2008

(87) PCT Pub. No.: WO2007/038447

PCT Pub. Date: Apr. 5, 2007

(65) Prior Publication Data

US 2008/0223532 A1 Sep. 18, 2008

Related U.S. Application Data

(60) Provisional application No. 60/721,894, filed on Sep. 28, 2005.

(51) Int. Cl.
*E06B 9/08* (2006.01)

(52) U.S. Cl. ..... 160/121.1; 160/87

(58) Field of Classification Search ..... 160/169, 160/167 R, 120, 320, 321, 121.1
See application file for complete search history.

(56) References Cited

U.S. PATENT DOCUMENTS

| | | | | |
|---|---|---|---|---|
| 4,813,468 | A * | 3/1989 | Fraser | 160/84.03 |
| 5,228,936 | A | 7/1993 | Goodhue | |
| 5,313,999 | A | 5/1994 | Colson et al. | |
| 5,791,390 | A * | 8/1998 | Watanabe | 160/84.03 |
| 5,897,731 | A | 4/1999 | Colson et al. | |
| 6,164,362 | A * | 12/2000 | Yang | 160/84.04 |
| 6,289,964 | B1 * | 9/2001 | Colson et al. | 160/121.1 |
| 6,435,252 | B2 * | 8/2002 | Colson et al. | 160/121.1 |
| 6,516,856 | B2 | 2/2003 | Lai | |
| 6,530,413 | B2 * | 3/2003 | Hwang | 160/84.03 |
| 6,834,701 | B2 * | 12/2004 | Colson et al. | 160/121.1 |

(Continued)

*Primary Examiner*—Katherine W Mitchell
*Assistant Examiner*—Jaime F Cardenas-Garcia
(74) *Attorney, Agent, or Firm*—Dorsey & Whitney LLP

(57) ABSTRACT

A top down/bottom up covering for an architectural opening is disclosed in a roll-up configuration so the shade can be rolled about a roller in a head rail while having the ability to raise and lower top and bottom rails between which the shade material extends independently of each other. The roller is utilized to raise and lower the bottom rail by wrapping about or unwrapping the shade material from the roller and a control system for raising and lowering the top rail is confined within the roller. The invention is disclosed in embodiments that include a single operating element or a pair of operating elements but in each instance the top and bottom rails are independently movable so the shade material can be extended to any degree between the top and bottom rails and positioned at desired locations within the architectural opening in which the covering is mounted.

21 Claims, 9 Drawing Sheets

U.S. PATENT DOCUMENTS

| | | | | |
|---|---|---|---|---|
| 7,063,122 | B2 * | 6/2006 | Colson et al. | 160/84.03 |
| 7,143,802 | B2 * | 12/2006 | Strand et al. | 160/84.04 |
| 2001/0001414 | A1 * | 5/2001 | Colson et al. | 160/178.1 R |
| 2002/0189771 | A1 * | 12/2002 | Colson et al. | 160/323.1 |
| 2004/0074611 | A1 * | 4/2004 | Colson et al. | 160/84.05 |
| 2004/0226663 | A1 * | 11/2004 | Smith et al. | 160/84.05 |
| 2005/0051281 | A1 * | 3/2005 | Lai | 160/167 R |
| 2007/0144686 | A1 * | 6/2007 | Drew | 160/170 |
| 2008/0053626 | A1 * | 3/2008 | Jarosinski et al. | 160/168.1 P |
| 2008/0149280 | A1 * | 6/2008 | Smith et al. | 160/121.1 |

* cited by examiner

ROLL UP COVERING FOR ARCHITECTURAL OPENINGS HAVING TOP DOWN/BOTTOM UP CAPABILITY

CROSS REFERENCE TO RELATED APPLICATIONS

This application claims the benefit of priority to U.S. provisional application No. 60/721,894, filed Sep. 28, 2005; such application, as well as provisional application No. 60/704,341, filed Aug. 1, 2005, are hereby incorporated by reference as though fully set forth herein.

BACKGROUND OF THE INVENTION

1. Field of the Invention

The present invention relates generally to retractable coverings for architectural openings and more particularly to a retractable covering that can be rolled about a roller in the retracted position of the covering with the covering having a top rail and a bottom rail that can be raised or lowered independently to give the covering top down/bottom up capability.

2. Description of the Relevant Art

Coverings for architectural openings have assumed numerous forms for centuries with early forms simply being fabric draped across architectural openings such as windows, doors, archways, or the like. Subsequently, retractable coverings for architectural openings became popular so the covering could be extended across the opening or retracted adjacent one or more sides of the opening. A popular form of a retractable covering for an architectural opening is a venetian blind wherein a plurality of slats are supported on cord ladders with the entire assemblage of slats being movable between an extended position across the architectural opening, wherein the slats are evenly distributed and horizontally disposed, to a fully retracted position where the slats assume a neat stack across the top of the opening. When the venetian blind is extended, the slats can also be pivoted about their longitudinal axes between open and closed positions to permit or block vision through the covering.

Vertical blinds are also a popular form of retractable covering for architectural openings and work very similarly to a venetian blind except where the slats are disposed vertically rather than horizontally. Again, the assembly of slats can be extended horizontally across the opening or retracted into a neat stack adjacent one or more sides of the opening and can also be pivoted about vertical axes when in the extended position between open and closed conditions.

More recently, cellular shades have become popular wherein a plurality of vertically or horizontally disposed cells are interconnected and movable between an extended position across an architectural opening and a retracted position adjacent one or more sides of the opening. Such cellular shades themselves can assume numerous forms such as disclosed in U.S. Pat. Nos. 5,313,999; 5,228,936; and 5,897,731.

In even more recent forms of retractable coverings for architectural openings, a bottom rail positioned along a lower edge of a shade material is reversibly movable vertically to extend or retract the covering but in addition, the top edge of the shade material is secured to a top rail which can also be raised or lowered relative to a head rail. Accordingly, the shade material, which extends between the top rail and the bottom rail, can be extended or retracted to any desired degree between the two rails and also positioned at any location across the architectural opening. This type of retractable covering is commonly referred to as a top down/bottom up covering.

Typically in top down/bottom up coverings, there are independent cord-operated systems for raising and lowering the top and bottom rails so they can be independently positioned at any desired location relative to each other. In such systems, when the rails are moved toward each other, the shade material is gathered between the two rails and when the rails are separated, the shade material extends between the routs.

Rollers have become a common form for retracting coverings for architectural openings with early forms of such rollers being on roll-up shades where a wooden roller simply had the top edge of a flexible sheet of shade material secured thereto and the lower edge had a bottom rail or ballast so when the shade material was unrolled from the wooden roller, it would extend across the architectural opening. A clutch mechanism was connected to the roller so the shade could be raised or lowered to any desired degree and would retain its position.

More recently, more sophisticated roller systems having transmissions and clutches for operation thereof have been utilized in coverings for architectural openings, but a simplified roll-up system for a top down/bottom up shade has been desired.

It is to provide a simplified system for rolling up a top down/bottom up shade that the present invention has been developed.

SUMMARY OF THE INVENTION

In the present invention, a roll-up shade includes a roller disposed in a head rail for the covering with two separate pairs of lift cords extending from the roller to the top and bottom rails respectively of the covering. A flexible shade material extends between the top and bottom rails so the top and bottom rails can be moved independently of each other to extend or retract the shade material or position it at a desired position across the architectural opening. The lift cords operatively associated with the bottom rail extend from an anchored location on the roller at a top end to an anchored location on the bottom rail at a bottom end. The roller is rotatably mounted on fixed end caps mounted in the architectural opening and rotatable with a drive member operatively associated with a flexible drive element for rotating the drive member through a clutch mechanism. The drive member selectively rotates the roller so the lift cords associated with the bottom rail can be wrapped around the roller with rotation of the roller in a first direction thereby raising the bottom rail toward the head rail in which the roller is mounted.

In two embodiments of the invention, a set of independent spools are rotatably mounted within the interior of the roller and have lift cords anchored thereto at a top end with the lift cords extending through an opening or slot in the roller and being anchored at a bottom end to the top rail. Rotation of the spools thereby wraps the second set of lift cords around the spools when they are rotated in a first direction so as to raise the top rail toward the head rail with rotation of the spools in an opposite direction allowing the lift cords associated with the top rail to extend thereby lowering the top rail by gravity.

A stop system may be incorporated into the interior of the roller that permits a predetermined number of rotations of the roller before stopping further rotation of the roller. The stop system is utilized to cooperate with the operation of the system in regulating relative rotational movement of the roller and the spools upon rotation of the driven member when lowering the covering.

As will be appreciated from the above, a single control element operates both the top and bottom rails through cooperation of clutches and possibly the stop system. In an alternative embodiment of the invention, separate control elements are utilized for raising and lowering the bottom rail and the top rail with one control element being adapted to rotate a roller which has lift elements connected thereto and to the bottom rail so that rotation of the roller affects raising and lowering of the bottom rail. The top rail is moved with a second control element or pull cord which is connected to lift elements associated with the top rail which extend around pulleys positioned within the roller and extend out of the roller for connection to the top rail.

Other aspects, features, and details of the present invention can be more completely understood by reference to the following detail description of the preferred embodiments, taken in conjunction with the drawings and from the appended claims.

DESCRIPTION OF THE PREFERRED EMBODIMENTS

Figure 2:
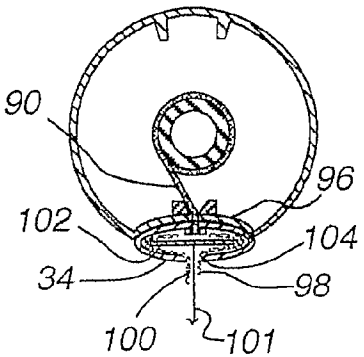
FIG. 2 is a section taken along line 2-2 of FIG. 1.
Figure 2A:
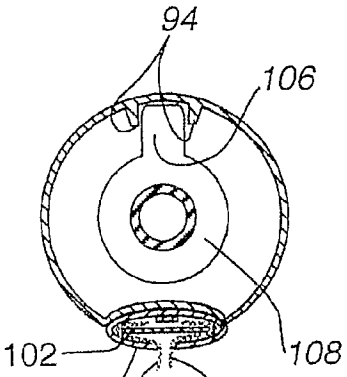
FIG. 2A is a section taken along line 2A-2A of FIG. 1.
Figure 1:
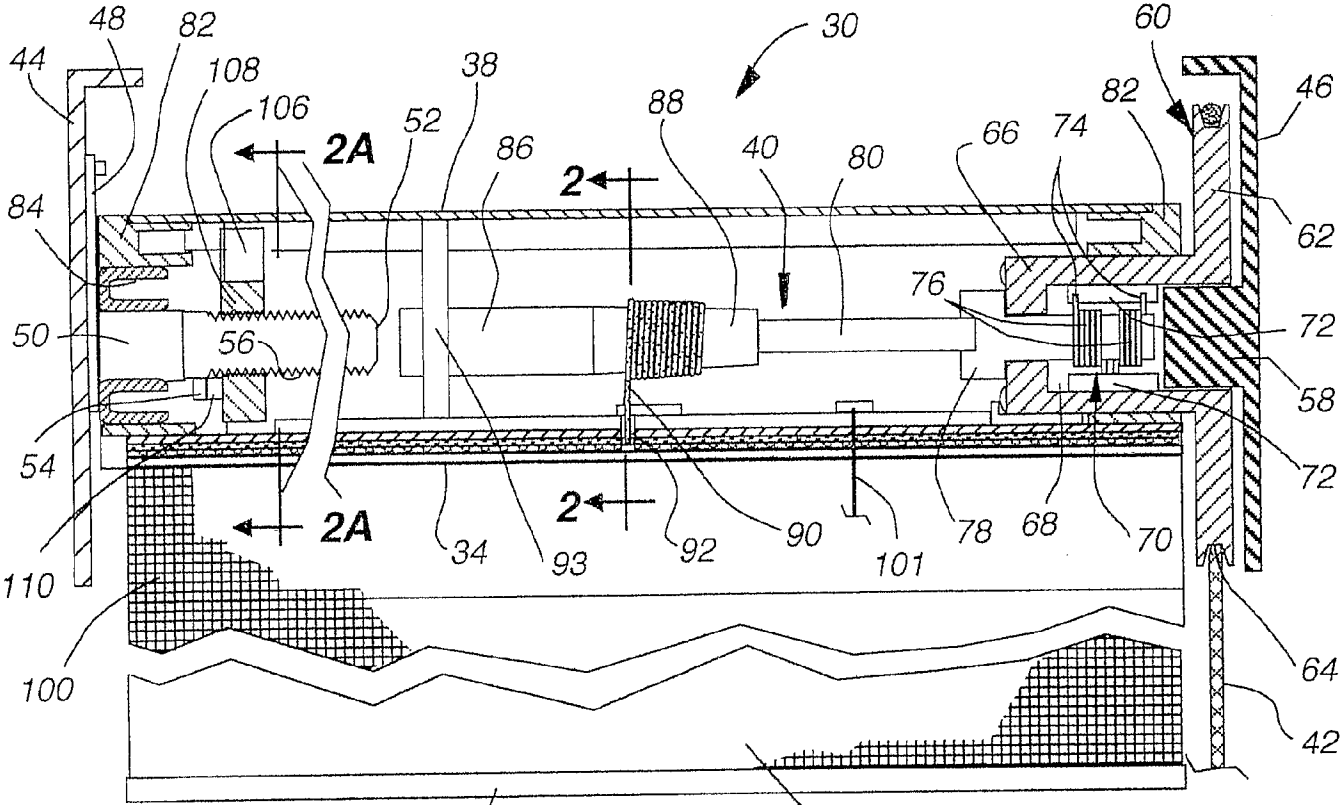
FIG. 1 is a vertical section taken through a covering in accordance with a first embodiment of the present invention with the flexible shade material and bottom rail not being seen.

A first embodiment 30 of the operating system of the present invention is shown in FIGS. 1-2A. The operating system is incorporated into a covering for an architectural opening that includes a flexible shade material 32 suspended between a top rail 34 and a bottom rail 36. As will be appreciated from the description that follows, both the top and bottom rails can be moved vertically and independent of each other between desired positions so the shade material can be completely gathered adjacent a head rail for the covering with both the top and bottom rails fully retracted adjacent to the head rail, both the top rail and the bottom rail can be fully extended so the shade material is gathered at a remote location from the head rail or the top and bottom rails can be independently positioned at desired locations between a fully retracted and fully extended position with the shade material extending therebetween to any desired degree.

The operating system 30 is of the roll-up type wherein the shade material can be wrapped around a roller 38 in the operating system when the bottom rail 36 is fully or partially retracted and can be unwound from the roller by extending the bottom rail away from the head rail. A secondary lift system 40 is positioned within the roller and is adapted to raise or lower the top rail 34 relative to the roller 38. In the first-described embodiment of FIGS. 1-2A, reciprocal vertical movement of both the top and bottom rail are controlled with one flexible control element 42 disposed at one end of the head rail so movement of the control element in one direction can lower the top and bottom rails independently of each other and movement of the control element in the opposite direction can raise the top and bottom rails independently of each other.

Looking particularly at FIG. 1, the roller 38 is seen extending between a pair of end caps 44 and 46 provided in a head rail (the remainder of which is not shown) with the end cap 44 at the left end of the roller having a support plate 48 anchored thereto wherein the support plate has an axially and inwardly extending shaft 50. The shaft is threaded from its distal end 52 over a substantial portion of its length toward the proximal end and has a stop or abutment tab 54 along a lower edge at a location approximately two thirds along the length of the shaft from the distal end toward the proximal end. The stop tab is positioned on the shaft proximate to the location of termination of the threads 56 on the shaft.

The right end cap 46 has a centered inwardly directed cylindrical hub or stub shaft 58 which serves as a bearing for a rotatable sheave 60 with the sheave having a disk-like outer end 62 adjacent to the end cap 46 with a peripheral groove 64 therearound in which the control element 42 is frictionally disposed and an inward cylindrical extension 66 defining a cavity 68 in which a two-way spring clutch 70 is positioned. The cylindrical extension has radially inwardly directed dogs 72 adapted to engage tangs 74 on a pair of oppositely wrapped clutch springs 76. The springs are disposed on a rotatable shaft 78 having a square (or non-circular) axial extension shaft 80 that could run substantially the full length of the roller 38. A friction coupling 82 is disposed in each end of the roller and at the right end of the roller the coupling engages the outer surface of the cylindrical extension 66 of the sheave 60 so as to only permit relative sliding movement between the coupling and the sheave upon a predetermined torque being applied to the coupling. The coupling 82 at the left end of the roller is disposed on a bearing 84 fixed around the shaft 50.

As mentioned previously, the square shaft 80 can extend substantially the entire length of the roller 38 and supports thereon a plurality of axially slidable spools 86 having a square passage therethrough so as to be keyed to the square shaft. Accordingly, the spools (only one of which is shown) rotate in unison with the square shaft. The spools have a tapered wrap surface 88 around which a lift cord 90 associated with the top rail 34 can be wound and unwound. Accordingly, one end of the lift cord 90 is anchored to an associated spool while the other end extends through an opening 92 provided along one longitudinal edge of the roller with the lower end of the lift cord being anchored in any suitable manner to the top rail. There are at least two spools 86 mounted in the roller and there could be more depending upon the length of the roller. The spools in addition to being supported on the square shaft are also supported on a bearing disassociated with each spool with the bearing disk being secured in any suitable manner along its periphery to the inner surface of the roller. If the length of the roller and thus the covering associated therewith were such that more than two lift cords associated with the top rail were appropriate, then more spools could be slidably mounted on the square shaft 80.

As best appreciated by reference to FIGS. 2 and 2A, the roller 38 itself has a pair of radially inwardly directed longitudinally extending ribs 94 spaced a predetermined distance along one portion of the roller and along an opposite edge, a generally semi-elliptical recess 96 is formed in the outer surface. The semi-elliptical recess generally conforms in configuration to the elliptical configuration of the top rail 34 even though the configuration of the top rail or the recess is not of particular relevance to the operating system itself.

As can be appreciated by reference to FIGS. 2 and 2A, while the shade material 32 can be most any suitable material, it is illustrated as having two separate flexible sheets with one sheet being a generally planar (when fully extended) backing sheet 98 and the other possibly a sheet 100 having a plurality of horizontally disposed draped portions simulating a roman shade. Lift cords 101 (FIG. 1) extending from a top anchored position in the roller 38 to a lower anchored position in the bottom rail 36 could extend between the two sheets as illustrated in FIG. 2 with the top edge of each sheet being anchored in the elliptical top rail 34 with an anchor bar 102 that is slid longitudinally into the top rail to crimp the two sheets within the top rail. The top rail of course would have a longitudinal slit 104 along its bottom edge through which the sheets of material and the lift cords could extend.

The inwardly projecting ribs 94 are spaced a distance so as to slidably receive a tab 106 on a stop nut 108 which is threadedly mounted on the shaft 50 to form a stop system. Accordingly, the nut will rotate with the roller 38 and since the shaft is fixed relative to the left end cap 44, the nut will translate longitudinally of the roller upon rotational movement of the roller relative to the fixed end caps. Translation of the nut to the left as viewed in FIG. 1 is stopped by an abutment stop 110 on the nut which engages the abutment tab 54 fixed to the shaft 50. The nut is correlated with the shaft so the nut translates to the left as viewed in FIG. 1 when the bottom rail 36 is being extended or dropping from the head rail and when the bottom rail reaches the predetermined desired fully extended position, the nut is in a position such that the abutment stop and the abutment tab engage thereby preventing any further downward movement of the bottom rail. When the bottom rail is being raised as when the roller 38 is being rotated in an opposite direction, the nut in the stop system translates to the right as viewed in FIG. 1 until the bottom rail engages the top rail in the fully retracted position of the top rail pursuant to the operation of the device to be set forth hereafter.

In describing the operation of the system, it will initially be assumed both the top rail 34 and bottom rail 36 are in a fully extended position and adjacent to each other with the shade material 32 gathered therebetween. Both the lift cords 101 associated with the bottom rail 36 and the lift cords 90 associated with the top rail 34 would be fully extended so the lift cords associated with the top rail are completely unwrapped from their associated spools 86. Rotating the control element 42 in a clockwise direction, as viewed from the right end of the system in FIG. 1, will cause the sheave 60 to rotate in a clockwise direction so the dogs 72 on the inside of the cylinder extension will engage the two tangs 74 on the clutch springs 76. The tang on the left spring as viewed in FIG. 1 will therefore tighten its spring onto the shaft 78 while the tang on the right as viewed in FIG. 1 will loosen its spring due to their reverse directions of wrap. Since the left clutch spring is gripping the shaft, it will cause the square shaft 80 and the spools mounted thereon to rotate in unison with the sheave in a clockwise direction thereby initially causing the lift cords 90 to wrap about the spools. Inasmuch as the spools can translate or slide along the square shaft, the wraps will be uniform and adjacent to each other as each wrap will urge the previous wrap to the right which will in turn urge the corresponding spool to the right.

The coupling 82 is designed so that the weight of the shade supported from the roller 38 and the slippage permitted between the sheave cylindrical extension 66 and the coupling permit the sheave to rotate while the roller remains stationary and thus the bottom rail 36 remains fully extended. As mentioned previously, the nut 108 in the stop system is also translated as far as it can go to the left as viewed in FIG. 1 when the bottom rail is fully extended.

When the top rail 34 has been fully raised into engagement with the roller 38 and is seated in the semi-elliptical pocket or recess 96 along the bottom edge of the roller, the spools 86 and the square shaft 80 will stop rotating as they cannot rotate any further. At this point, the friction between the coupling 82 and the cylindrical extension 66 on the sheave 60 is sufficient to rotate the roller upon continued rotation of the sheave so that everything rotates together about the longitudinal center axis of the roller. That is, the roller, the square shaft, the spools mounted thereon, and the top rail all rotate together.

As the roller 38 is being rotated in a clockwise direction, as viewed from the right end in FIG. 1, the shade material 32 starts wrapping about the roller and the stop nut 108 translates to the right as viewed in FIG. 1. Once the bottom rail 36 operatively engages the top rail 34 with the shade material gathered therebetween, the roller cannot be rotated any further in a clockwise direction.

Accordingly, when raising the covering from a position with both the top 34 and bottom 36 rails fully extended adjacent to each other with the shade material 32 gathered therebetween, the top rail is first caused to be raised until it engages the roller 38 and subsequently the bottom rail automatically begins to rise since the roller to which the top rail and thus the top edge of the shade material is engaged starts rotating with the roller until the top rail is fully raised and the fabric completely wrapped about the roller. As will be appreciated, the stop nut 108 at this position is translated as far to the right, as viewed in FIG. 1, as it will go.

To lower the covering from the fully retracted position of both the top 34 and bottom 36 rails, the sheave 60 is rotated with the control element 42 in the opposite or counterclockwise direction as viewed from the right in FIG. 1. The friction between the coupling 82 and the cylindrical extension 66 of the sheave is greater than the friction associated with the rotation of the square shaft 80 and, accordingly, the roller will start rotating in a counterclockwise direction in unison with the sheave and of course the square shaft, spools, and top rail will also rotate in unison with the roller. As will be appreciated from the double-spring clutch 70, when the sheave is rotating in the counterclockwise direction, the spring 76 on the left as viewed in FIG. 1 is loosened from the shaft 78 but the spring 76 on the right is tightened when the dogs within the cylindrical extension engage the tangs of the springs. It should also be appreciated the springs are somewhat tightly wrapped about the shaft so when the sheave is not being rotated, the springs grip the shaft 78 and the shaft is prevented from rotation by the spring tangs engagement with the dogs so the covering is retained in a set position.

Counterclockwise rotation of the sheave causes the stop nut 108 to translate to the left as viewed in FIG. 1 and when the stop nut abutment stop 110 engages the abutment tab 54 on the shaft, the nut cannot translate any further to the left and since the nut is mechanically connected to the roller 38 as shown in FIG. 2A, the roller will also stop rotating. Also as mentioned previously, at this position, the bottom rail 36 has been fully extended and will be desirably positioned relative to the sill (not shown) of the architectural opening.

Continued counterclockwise rotation of the sheave 60 will cause the sheave cylindrical extension 66 to slide relative to the coupling 82 so the square shaft 80 will continue to rotate even though the roller 38 has stopped rotating. As the square shaft rotates, so do all of the spools 86 mounted thereon so the lift cords 90 on the spools, which are connected to the top rail 34, are allowed to unwind from the spools until the top rail has been fully extended into a position closely adjacent to the bottom rail with only the shade material gathered therebetween.

It will be appreciated from the above the bottom rail 36 and top rail 34 are independently movable with the same control element 42 so the top and bottom rails can be positioned at many desired positions relative to each other and relative to the head rail and the architectural opening in which the covering is mounted.

A second embodiment 120 of the operating system of the present invention is shown in FIGS. 3-14. This embodiment is also designed for operating a top down/bottom up type covering for an architectural opening wherein the covering has a top rail 122, a bottom rail 124, a flexible shade material 126 extending therebetween and an operating system 128 for independently moving the top and bottom rails so the shade can be extended or retracted to varying degrees and positioned at desired locations within the architectural opening.

Figures 3, 4, 5, 6:
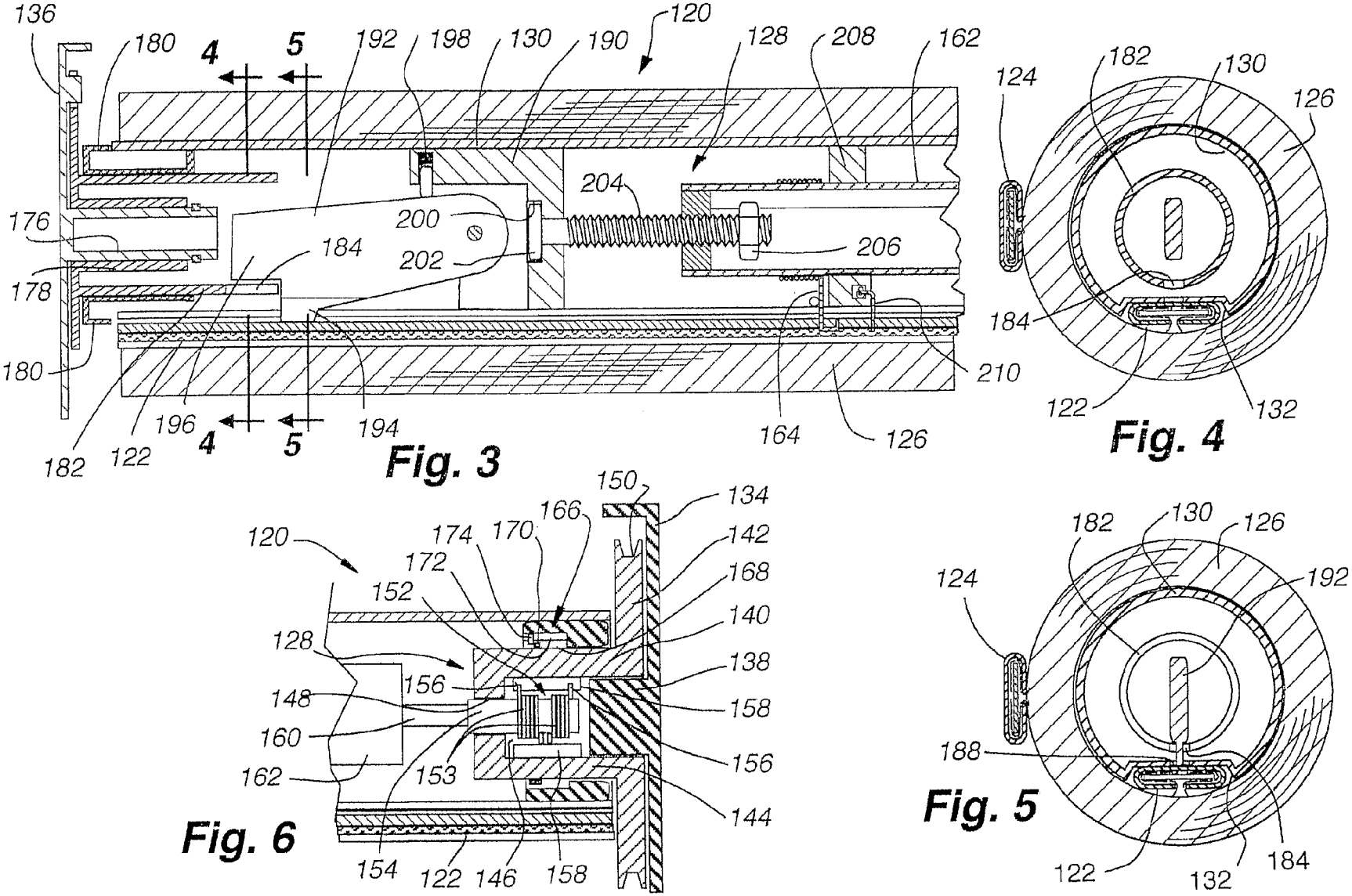
FIG. 3 is a fragmentary vertical section taken through the left end of a second embodiment of the present invention.
FIG. 4 is a section taken along line 4-4 of FIG. 3.
FIG. 5 is a section taken along line 5-5 of FIG. 3.
FIG. 6 is a vertical section similar to FIG. 3 showing the right end of the covering.

Referring first to FIGS. 3-6, with FIG. 3 showing the left end of the operating mechanism and FIG. 6 the right end and with portions omitted therebetween, it will be seen the operating system includes a generally cylindrical roller 130 having a longitudinal recess 132 formed along one portion thereof so as to define a pocket in which the top rail 122 can be seated when the top rail is fully retracted. The roller 130 is reversibly and rotatably mounted in a head rail that includes a pair of end caps with one end cap 134 at the right end as seen in FIG. 6 and one end cap 136 at the left end as seen in FIG. 3. Referencing the right end, the end cap 134 has a cylindrical stub shaft 138 that forms a bearing for a reversibly rotatable sheave 140 having a disk 142 on an outer end thereof and an inwardly directed cylindrical extension 144 defining an inner cavity 146 and a passage 148 through the innermost end thereof. The disk portion 142 of the sheave has an annular groove 150 for receipt of a flexible control element (not shown) for rotating the sheave in either direction. The cylindrical extension 144 houses a double-spring clutch 152 having first and second clutch springs 153 mounted on a shaft 154 so as to grip the shaft in a resting position but with the wrap of each spring being opposite and with each spring having an outwardly projecting tang 156 for engagement with dogs 158 provided on the inner surface of the cylindrical extension. The dogs are designed to engage the tangs of the clutch springs upon rotation of the sheave. The shaft 154 upon which the clutch springs are mounted protrudes through the passage 148 in the innermost end of the cylindrical extension and supports a square or other non-circular shaft 160 that extends horizontally along the axis of the roller. The square shaft supports a cylindrical lift spool or cord guide surface 162 associated with a plurality of lift cords 164 adapted to raise and lower the top rail 122 as will be described hereafter. The right end of the lift spool is seen in FIG. 6 with the left end seen in FIG. 3. The square shaft extends horizontally through the right end of the spool toward the left end. The spool has a square passage (not seen) through the right end thereof for receipt of the square shaft so the spool rotates in unison with the shaft.

A slip clutch system 166 is seated within the roller 130 at the right end thereof to rotate with the roller and has a recess 168 formed therein in confronting relationship with the cylindrical extension 144 of the sheave 140. The recess includes a coil spring 170 with only a few wraps. A dog 172 is formed in the recess on the slip clutch so as to engage the tang 174 of the spring. The function of the spring is to provide a predetermined friction between the cylindrical extension of the sheave and the slip clutch so the degree of friction can be controlled by the number of wraps on the spring.

At the left end of the system as shown in FIG. 3, the left end cap 136 is shown having an integral inwardly projecting axial inner fixed bearing 176 on which an outer fixed bearing member 178 is mounted. Both bearings are fixed relative to the end cap and interface with the roller 130 through an outer bearing member 180 that is secured to the roller for unitary rotation therewith. The outer fixed bearing has a circular outer component 182 having a notch 184 formed at a bottommost portion thereof. The notch opens through the inner end of the outer fixed bearing for a purpose to be described hereafter.

The roller 130 is of generally cylindrical configuration and as mentioned has a longitudinal recess 132 formed therein to seat the top rail 122 when the top rail is fully retracted. A longitudinal slot 188 is formed along the center of the recess for a purpose to be described hereafter.

Positively positioned within the interior of the roller 130 is a mounting block 190 near the left end of the roller which pivotally supports a lever arm 192 having a downwardly projecting leg 194 and a horizontally projecting leg 196. A spring 198 is mounted within the mounting block in engagement with the lever arm to bias the lever arm in a counterclockwise direction. The mounting block also has a non-circular typically hexagonal seat 200 formed therein which receives a corresponding non-circular or hexagonal head 202 of a threaded shaft 204 with the threaded shaft having an adjustable lock nut 206 positioned near its distal end. Also threadedly received on the shaft 204 is the left end of the cylindrical spool 162 on which the lift cords 164 for the top rail 122 are connected and wrappable. Other dividers 208 are positioned within the roller 130 and form bearing supports for the spool at locations where it may be desirable but particularly on the left end of the spool as seen in FIG. 3 inasmuch as the square shaft 160 does not extend completely through the spool.

Figure 7:
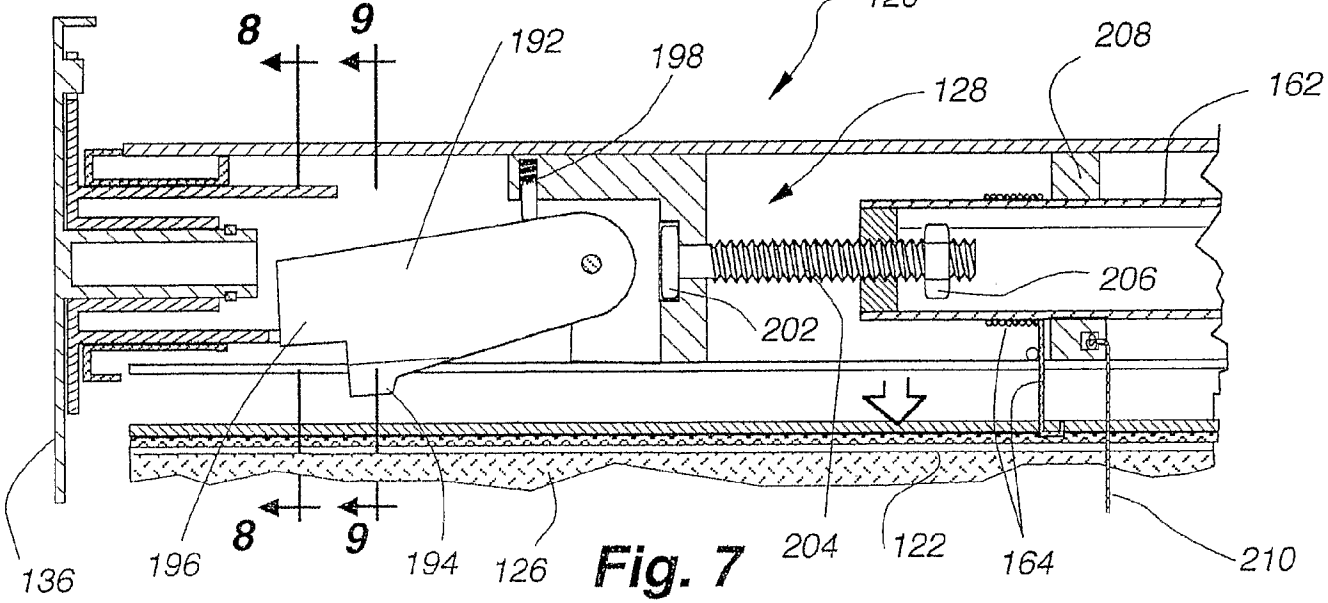
FIG. 7 is a section similar to FIG. 3 with a lock arm in a different position from that shown in FIG. 3.
Figure 9:
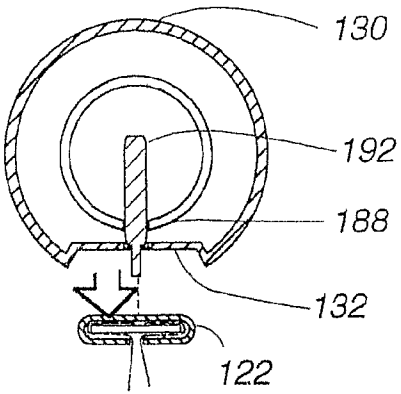
FIG. 9 is a section taken along line 9-9 of FIG. 7.
Figure 8:
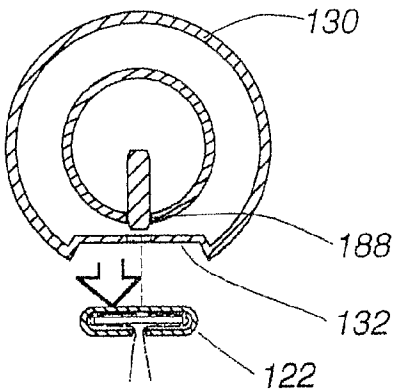
FIG. 8 is a section taken along line 8-8 of FIG. 7.
Figure 11:
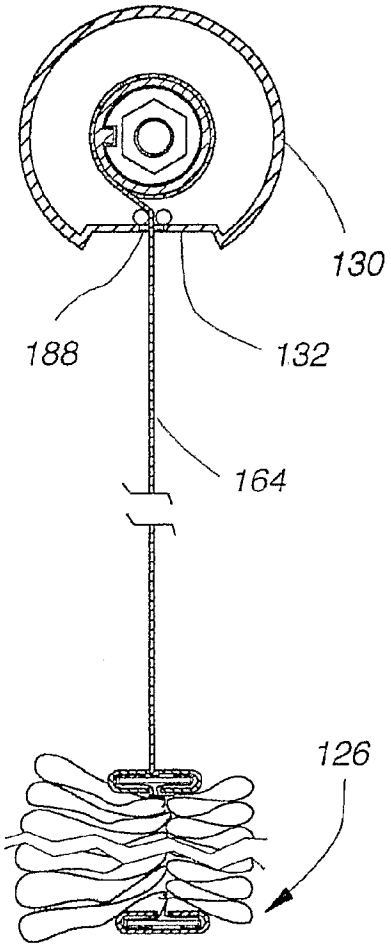
FIG. 11 is a section taken along line 11-11 of FIG. 10.
Figure 10:
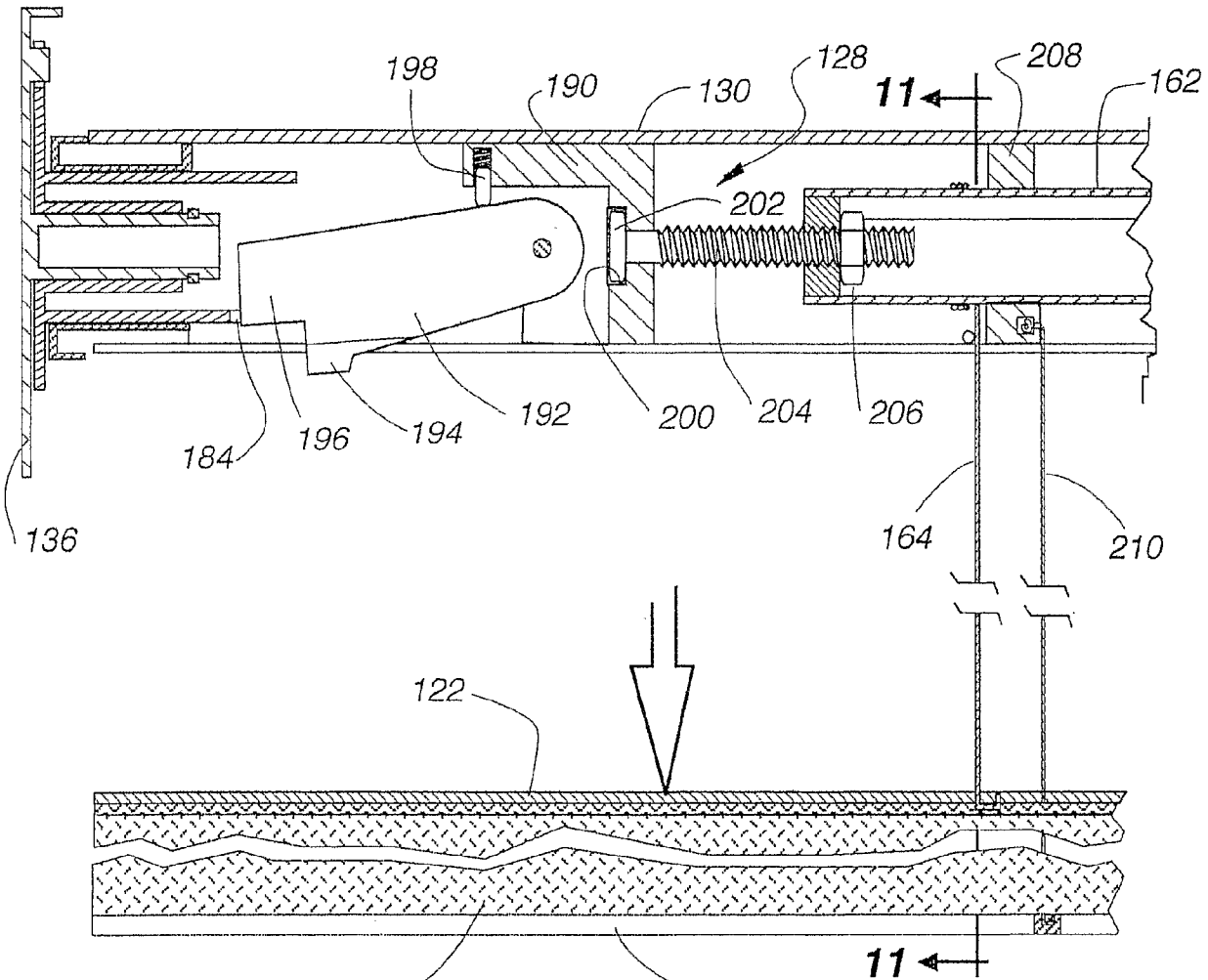
FIG. 10 is a section similar to FIG. 7 and including the bottom rail.

The longitudinal slot 188 in the roller 130 allows the lift cords 164 associated with the top rail 122 to extend from the spool 162 to the top rail for attachment thereto in any conventional manner. Accordingly, the upper ends of the lift cords are anchored to the spool while the lower ends are anchored to the top rail so the cords can be wrapped around the spool as will be described hereafter. The longitudinal slot 188 in the roller also receives the downwardly projecting leg 194 of the lock lever 192 so the bottom leg can extend through the slot and into engagement with the top rail when the top rail is fully retracted as shown in FIGS. 3-6. As will be appreciated, however, when the bottom rail is lowered from its seat in the roller, the bottom leg of the lock lever will drop downwardly under the bias of gravity and the spring 198 and in doing so, the horizontal leg 196 of the lock lever will drop from the position shown in FIG. 3 above the notch 184 in the bearing member into the notch in the bearing member as shown in FIG. 7.

In operation, if both the top 122 and bottom 124 rails are fully extended and in closely adjacent relationship with each other with only the shade material 126 gathered therebetween, rotation of the sheave 140 in a counterclockwise direction as viewed from the right in FIG. 6 will initially release one of the clutch springs 153 while tightening the other clutch spring so the rotation of the sheave also rotates the square shaft 160 operatively associated therewith and the spool 162 that is mounted thereon. The friction between the sheave and the slip clutch 166 through the relatively weak coil spring 170 is not great enough to cause the roller 130 to rotate with the sheave and further, since the top rail does not occupy the seat in the roller as mentioned previously, the lock lever arm 192 is in its downwardly pivoted position of FIG. 7 which prevents rotation of the roller relative to the end caps due to the horizontal leg 196 of the lock lever being disposed in the notch 184 of the outer fixed bearing member 178.

Accordingly, as the sheave 140 is rotated in a counterclockwise direction, the lift cords 164 are wrapped around the spool 162 and as the spool rotates, the threaded shaft 204, which is stationary relative to the threaded spool, causes the spool to translate to the left so that additional space is provided on the spool for another wrap of each lift cord. Further, the mounting blocks 190 or dividers 208 also anchor the upper end of lift cords 210 that extend downwardly through the slot 188 in the roller 130 for connection to the bottom rail 124.

Once the bottom rail 124 has been elevated or retracted totally into the recess 132 in the roller, it shoves and pivots the lock lever 192 upwardly so the horizontal leg 196 of the lock lever is removed from the notch 184 in the bearing member 178 so further rotation of the sheave 140 causes the roller 130 to rotate through the friction provided by the spring 170 around the cylindrical extension 144 of the sheave. Of course, during rotation of the roller, everything rotates with the roller including the spool as well as the top rail operatively associated with the spool through the lift cords.

Once the bottom rail 124 is fully elevated with the shade material 126 wrapped around the roller, the sheave 140 can be turned no more and, accordingly, the covering is fully retracted with the top and bottom rails in closely adjacent relationship within the head rail and with the shade material gathered therebetween.

To lower the covering from the position wherein both the top 122 and bottom 124 rails are fully retracted, the sheave 140 is rotated in a clockwise direction as viewed from the right end of FIG. 6 with the friction provided by the coil spring 170 again causing the roller 130 to rotate with the sheave until the bottom rail is fully extended and the weight of the shade material 126 then pulls the top rail 122 down slightly as illustrated in FIG. 7, which allows the lock lever 192 to pivot counterclockwise dropping the horizontal leg 196 into the notch 184 in the bearing 178 to prevent further rotation of the roller. The sheave, of course, can continue to rotate in a clockwise direction. Only now since the roller will not rotate, the spring 170 allows slippage between the roller and the cylindrical extension of the sheave so the sheave continues to rotate and through the double-clutch springs 152, as mentioned previously, and rotates the square shaft 160 in a clockwise direction thereby rotating the spool accordingly and unwinding the lift cords from the spool allowing the top rail to drop by gravity. As the top rail is dropping by gravity and the spool is rotating clockwise, the spool is translating to the right along the threaded shaft 204 until it abuts the lock nut 206 which has been prepositioned to stop rotation when the top rail is immediately adjacent to the bottom rail in the fully extended position with the shade material 126 gathered therebetween.

Figure 12:
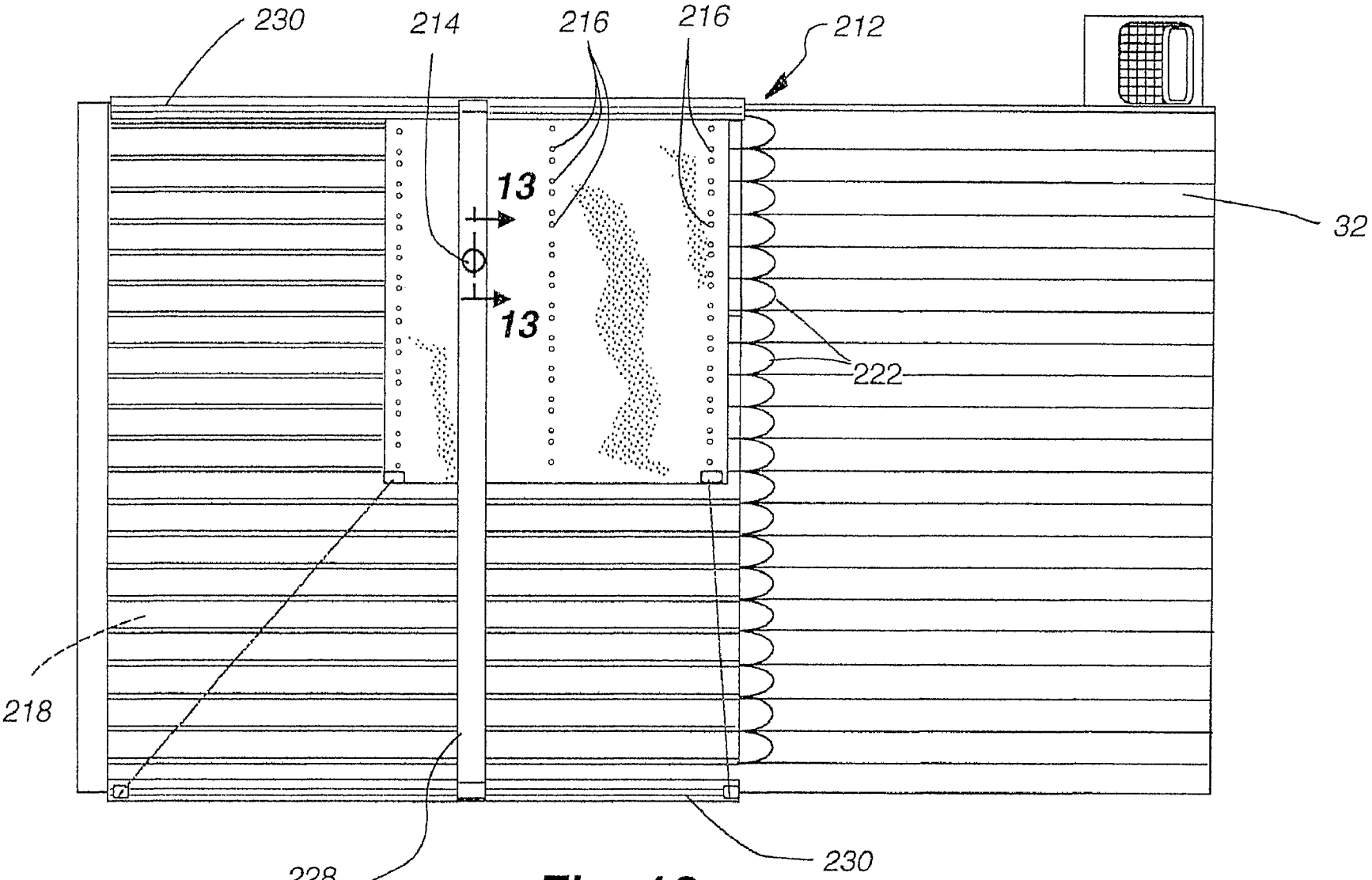
FIG. 12 is a diagrammatic view of an apparatus for perforating a shade material of the type adapted for use in the covering of FIGS. 3-11 prior to connecting the shade material to the control system for the covering.
Figure 14:
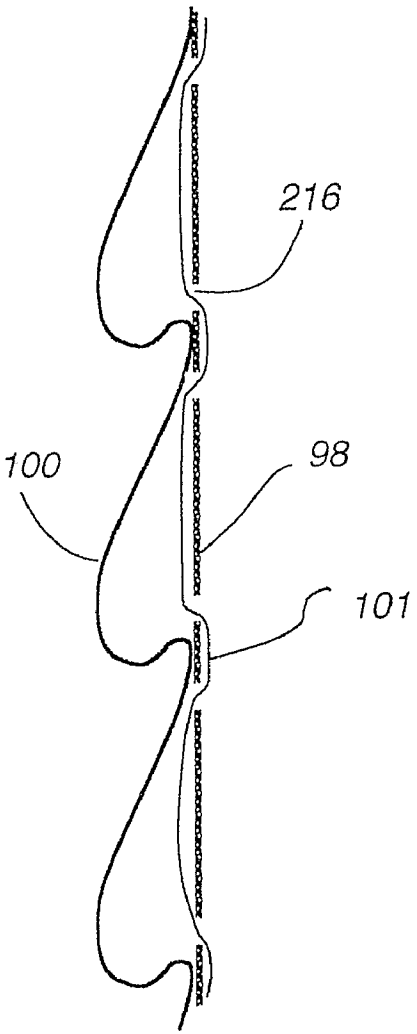
FIG. 14 is a vertical section taken through the shade material made in accordance with FIGS. 12 and 13 and showing a lift cord being threaded through the material.
Figure 13:
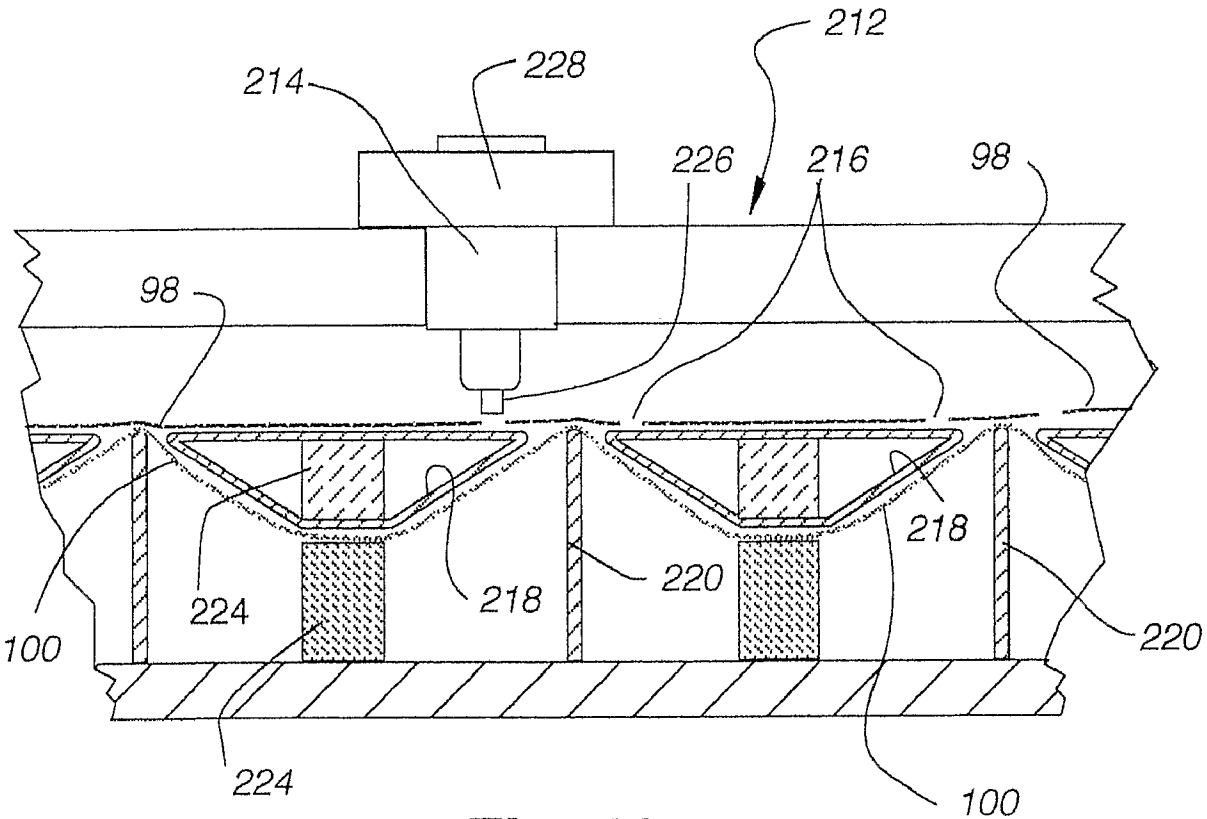
FIG. 13 is a fragmentary vertical section taken along line 13-13 of FIG. 12.

FIGS. 12-14 illustrate a manufacturing process for the illustrated shade materials 32 and 126, which can be used with the top down/bottom up operating systems described hereinabove. As mentioned in the first-described embodiment, the shade material 32 can be a two-piece material having a backing sheet 98 which when fully extended is substantially planar and a front sheet 100 having a plurality of loops formed thereon to simulate a roman shade. In FIG. 12, the shade material is completely spread out on an apparatus 212 or the like with a hole-forming device 214 for forming a plurality of holes 216 at predetermined locations through which lift cords 101 can be threaded from the roller 38 to the bottom rail 36 (FIG. 1).

The apparatus 212 for forming the holes 216 can be seen in FIGS. 12 and 13 to comprise a jig on which the shade material 32 can be positioned so that the hole-forming device 214 can be moved in a matrix to form holes in the backing sheet 98 of the shade material at any desired location. As is best appreciated by reference to FIG. 13, the shade material is placed on the apparatus so the looped material 100 faces downwardly and is threaded onto a plurality of horizontally spaced parallel rails 218 of trapezoidal transverse cross-section with vertical supports 220 extending between the trapezoidal rails. The flat backing sheet 98 of material overlies the trapezoidal rails while the looped material extends around the rails. The rails may be rounded at one end 222 as shown in FIG. 12 so the material is easily threaded onto the apparatus from one end. Each rail 218 is supported by a pair of support bars 224 that are spaced at an intermediate location to allow room for the trapezoidal rail itself to extend therethrough and for the looped fabric 100. With the fabric threaded onto the rails, it is desirably supported so that the holes can be formed in the flat sheet of material 98.

The holes 216 are formed with a laser or heat device having a head 226 approximately the size of the holes to be formed which points downwardly and is immediately adjacent to the flat sheet of material. The hole-forming device is universally movable in a horizontal plane through its mounting on a transverse rod 228 that has its opposite ends slidably mounted on longitudinal tracks 230. Of course, by sliding the transverse rod along the tracks, the hole-forming device 214 can be moved longitudinally of the looped cells in the material 100, and by sliding the hole-forming device along the length of the transverse rod, it can be moved transversely of the cells.

With reference to FIG. 13, it is desirable to form a longitudinal line of holes 216 in the material 98 transversely of the cells so a lift cord 101 can be threaded through the holes. When forming the holes, however, it is important the holes only be formed in the flat backing sheet of material 98 and not in the looped sheet 100 which is visible to the interior of the room in which the covering is mounted. As illustrated in FIG. 13, the hole-forming device has formed a plurality of holes 216 in the flat sheet material 98 and it will be appreciated each hole is above the trapezoidal rail 218 so the rail prevents the hole-forming device from forming a hole in the looped material 100 in addition to the flat sheet material. After the desired number of rows of holes have been formed, which corresponds with the number of lift cords 101 associated with the bottom rail 36, the sheet material 26 is removed from the apparatus and the lift cords 101 associated with the bottom rail are threaded downwardly through the holes as shown in FIG. 14 so they extend behind the sheet material 98 at a location where the front looped material 100 is secured to the rear sheet material and in front of the rear sheet material at locations where a loop is formed in the front material. Of course, the lift cords are free to slide within the holes formed so the top and bottom rails of the covering can be moved independently of each other with the fabric being gathered or extended therebetween.

A third embodiment 240 of a roll-up covering having top down/bottom up capability is shown in FIGS. 15-21. This embodiment of the invention is similar to the previously-described embodiments in that the operating mechanism includes a roller 242 around which shade material 244 can be wrapped and a mechanism 246 interiorly of the roller for raising and lowering a top rail 248, but the mechanism is operated with a pair of control elements 250 and 252 rather than a single element as in the first-described embodiments.

As seen in FIG. 15, the roller 242 is again reversibly and rotatably mounted between a right 254 and left 256 end caps of a head rail for the covering and wherein the flexible shade material 244 is suspended between the top 248 rail and a bottom 258 rail both of which are vertically movable independently of the other so the shade material can be extended to any desired degree and positioned in a desired location within the architectural opening in which the covering is mounted.

Figures 15, 16:
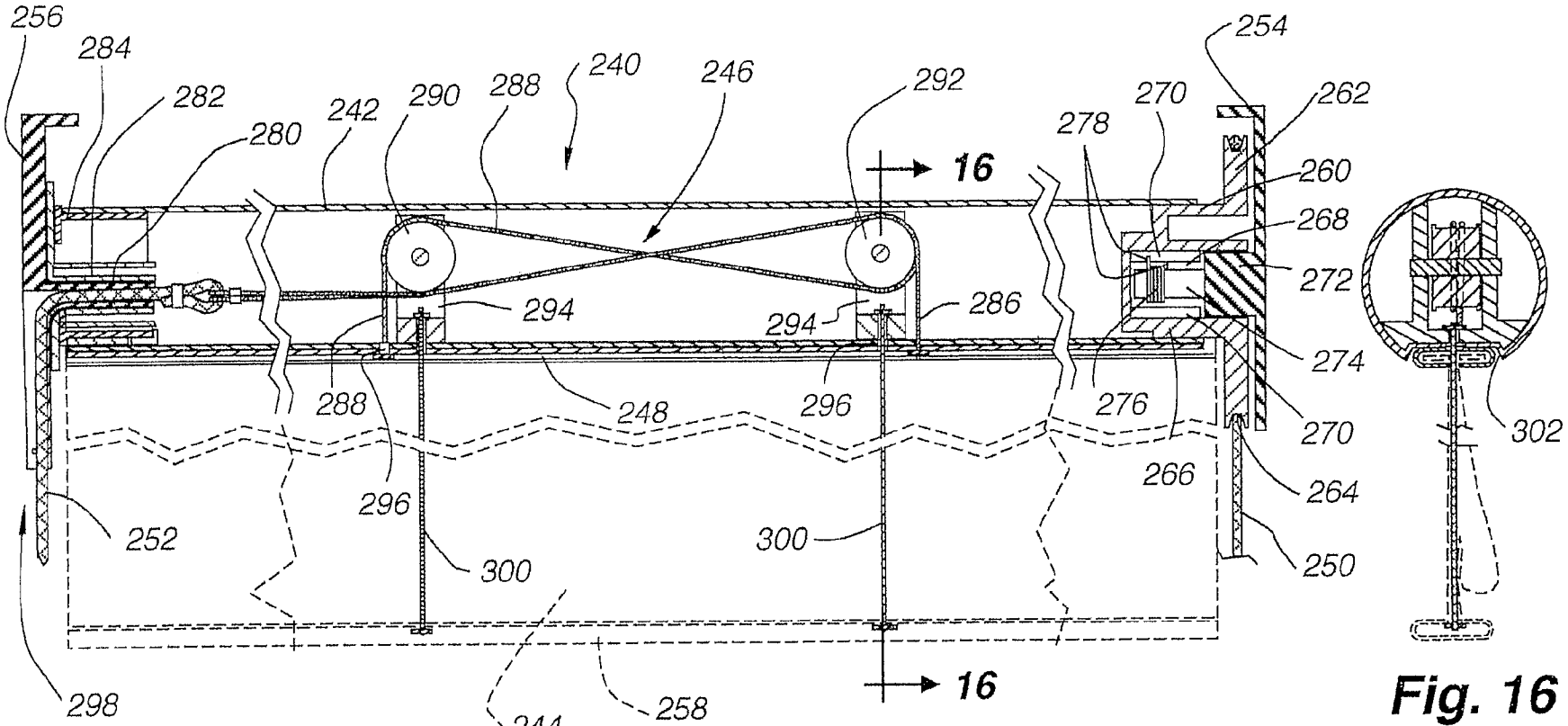
FIG. 15 is a diagrammatic vertical section through a third embodiment of the present invention.
FIG. 16 is a section taken along line 16-16 of FIG. 15.

Looking first at the right end of the covering as shown in FIG. 15, the roller 242 is shown fixedly supported on a sheave 260 for unitary rotation therewith. The sheave includes a disk-like outer end component 262 with a peripheral groove 264 adapted to frictionally receive the control element 250 and a generally cylindrically inwardly extending portion 266 having a hollow cavity 268 therein. Within the cavity, the cylindrical extension includes a plurality of radially inwardly projecting dogs 270. The sheave is rotatably mounted on a stub shaft 272 of the right end cap 254 and the stub shaft includes a reduced diameter inward shaft extension 274 on which a single clutch spring 276 is disposed. Opposite ends of the clutch spring define tangs 278 projecting upwardly on either side of the reduced diameter shaft 274 and the dog on the sheave is positioned between the tangs. Accordingly, while the spring will tightly grip the reduced diameter shaft in a rest position so as to prevent the sheave from rotating relative to the end cap 254, torque applied to the sheave through the control element 250 will cause the dog to engage one tang or the other dependent upon the direction of rotation to release the grip of the clutch spring 276 on the reduced diameter shaft allowing the sheave to rotate relative to the end cap. Of course, rotation of the sheave also causes rotation of the roller 242 which is fixedly mounted thereon for unitary rotation therewith.

At the left end of the system as seen in FIG. 15, the left end cap 256 has an inwardly directed hollow shaft 280 defining a bearing seat for a fixed inner bearing element 282 which rotatably supports a rotatable outer bearing element 284 that is fixed to the roller 242 for unitary rotation therewith. Accordingly, when the roller is rotated with the sheave 260 at the right end of the system, the roller is free to rotate at the left end. A pull cord defining the control element 252 projects inwardly through the hollow shaft 280 on the left end cap and hangs downwardly from outside the left end of the covering for access by an operator of the covering. The pull cord at its upper end is connected to a pair of lift cords 286 and 288 whose opposite ends are anchored or otherwise connected to the top rail 248 at spaced locations along the length of the top rail. A pair of pulleys 290 and 292 are mounted on fixed brackets 294 within the roller with the pulleys having rotational axes that are transverse to the roller. The lift cords 286 and 288 leave their connection with the pull cord 252 and extend generally horizontally to the right as shown in FIG. 15 so they pass beneath the left pulley 290 and over the right pulley 292 with one 286 of the cords then extending downwardly from the right pulley through a hole or slot 296 in the roller for attachment to the top rail at a location substantially vertically aligned with said pulley 292. The second lift cord 288 wraps around the right pulley and then extends from beneath the right pulley in a reverse direction over the left pulley 290 and then downwardly through a hole or slot 296 in the roller for connection to the top rail at a location substantially vertically aligned with said pulley 290. It will therefore be appreciated that when the pull cord 252 is pulled downwardly, the lift cords 286 and 288 through their circuitous route around the pulleys 290 and 292 lift the top rail. If the pull cord is allowed to rise, the top rail will lower through gravity. A cord lock system 298 to be described later is also operatively connected with the left end cap 256 for engagement with the pull cord to selectively hold the pull cord in any desired position.

Each bracket 294 holding the left 290 and right 292 pulleys also anchors the top end of a lift cord 300 in a second set of lift cords whose lower ends are secured to the bottom rail 258. The lift cords 300 pass through holes in the roller or the longitudinal slot 296 in the roller which could accommodate both sets of lift cords 286, 288, and 300. The roller 242, as appreciated by reference to FIG. 16, has a longitudinal recess 302 formed therein that defines a seat for the top rail 248 when the top rail is fully retracted as shown in FIGS. 15 and 16.

Figure 21:
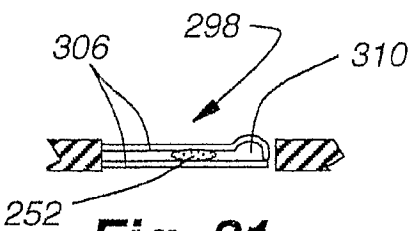
FIG. 21 is a section similar to FIG. 20 showing the pull cord in a clamped position.
Figure 18:
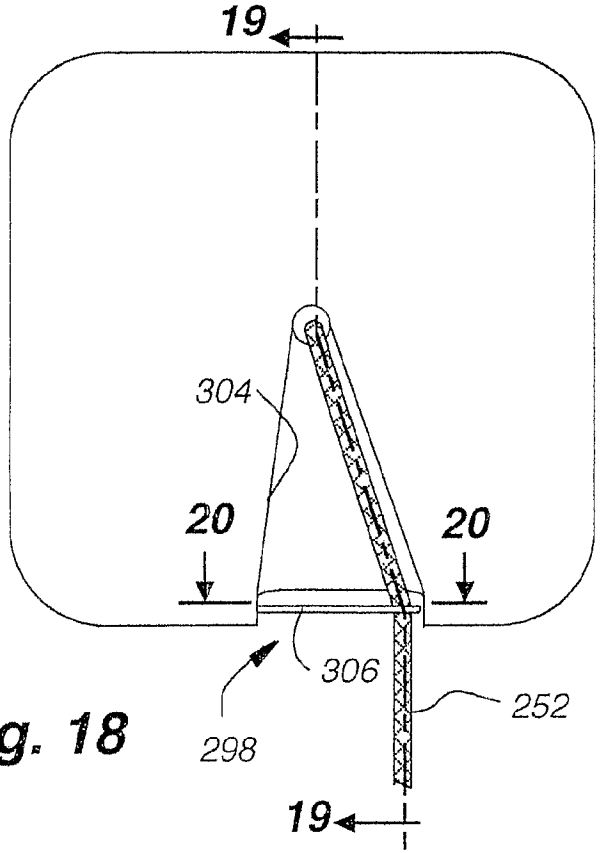
FIG. 18 is an enlarged left end elevation of the covering shown in FIG. 15.
Figure 20:
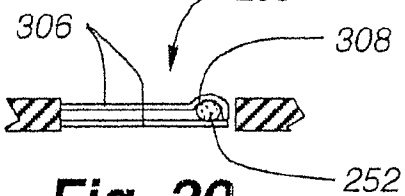
FIG. 20 is a section taken along line 20-20 of FIG. 18.

The cord lock system 298, which is probably best seen in FIGS. 18-21, is disposed in a triangular notch 304 formed in the left end plate seen in FIG. 18. The cord lock as seen in FIGS. 20 and 21 consists of a pair of spaced, horizontal resilient rods 306 with one of the rods having a loop 308 at one end that defines a gap 310 between the rods large enough to slidably receive the pull cord 252. The spacing between the rods, however, other than at the gap, is narrow enough to pinch the cord. Accordingly, when operating the pull cord to either raise or lower the top rail, the cord is positioned in the gap 310, as shown in FIGS. 18 and 20, and pulled down or allowed to rise up with the cords sliding through the gap. When the top rail 248 is positioned at a desired location, the pull cord is merely pulled to the left as viewed in FIG. 18 until it is pinched between the rods as shown in FIG. 21 where it is frictionally retained in place.

In operation, the top rail 248 can be raised by simply pulling the pull cord 252 which in turn pulls the lift cords 286 and 288 connected therewith causing the top rail to rise. Of course, when the top rail is fully raised, as shown in FIGS. 15 and 16, it is seated in a recess 302 in the roller 242 and cannot go any further. If it is desired to retain the top rail in this position, the pull cord is pulled to the left as viewed in FIG. 18 so as to be pinched in the cord lock 298 to hold it in position. Of course, the top rail can be lowered by positioning the pull cord in the gap 310 and allowing the top rail to drop by gravity.

With the top rail 248 fully raised, or even partially raised, the bottom rail 258 can be raised by rotating the sheave 260 at the right end of the system with the control element 250 which causes the roller 242 to rotate as described previously thereby wrapping the shade material 244 about the roller until the bottom rail also operatively engages the roller. At this point in time, the sheave rotation is discontinued and the clutch spring 276 locks the shaft so the roller cannot rotate thereby retaining the top rail in its elevated position.

Clearly from the above, it will be appreciated both the top 248 and bottom 258 rails can be independently moved to any degree between fully extended and fully retracted positions so the shade material 244 can be extended to any degree between the top and bottom rails and positioned at a desired location within the architectural opening within which the covering is mounted.

Figure 17:
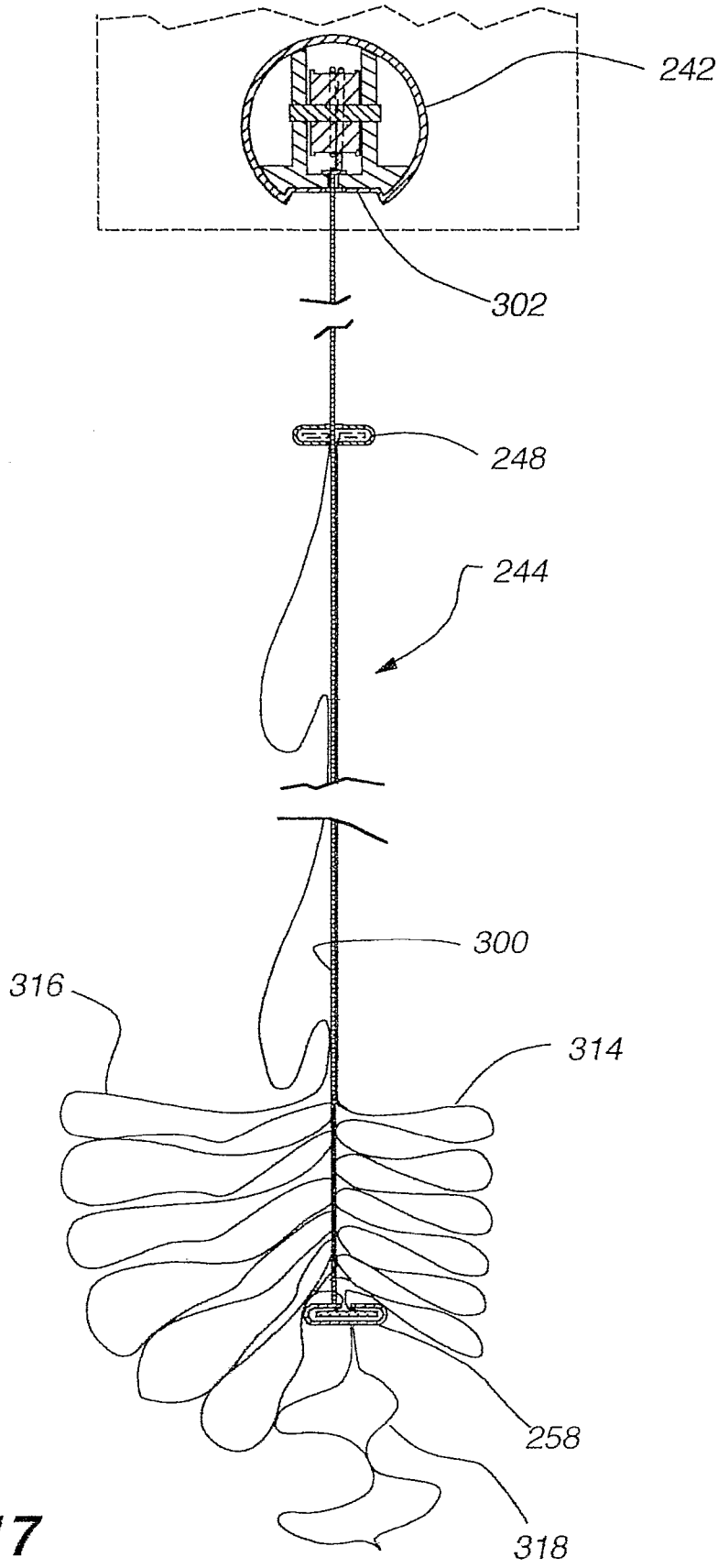
FIG. 17 is a side elevation of the shade shown in FIG. 15 with the top rail partially extended relative to the bottom rail.
Figure 19:
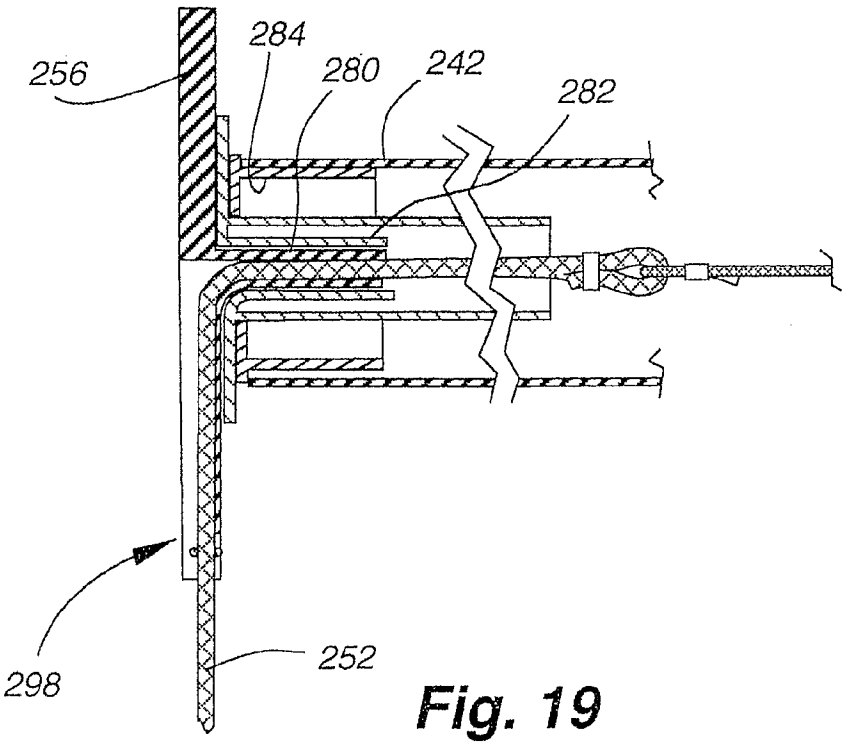
FIG. 19 is a fragmentary section taken along line 19-19 of FIG. 18.

FIG. 17 illustrates the covering of FIG. 15-21 with the bottom rail 258 fully extended and the top rail 248 partially extended. The shade material 244 illustrated in FIG. 17 is in accordance with the shade material described previously with the other embodiments of the invention wherein one sheet of material 314 lies on one side of the lift cords 300 associated with the bottom rail 258 and the other sheet of material 316, which is looped, lies on the opposite side. Accordingly, when the shade material 244 gathers between the top and bottom rails, the one sheet of material 314 gathers on one side of the lift cords and the looped sheet of material 316 gathers on the opposite side. A lower valence sheet of material 318 is shown suspended from the bottom rail 258, which can be aesthetically coordinated with the shade material 244 and which provides a material for filling any gap between the bottom rail and the sill (not shown) of the architectural opening. Of course, the valence sheet of material is not necessary and the shade material could assume numerous types other than the shade material illustrated.

It will be appreciated from the above that an operating system for a top down/bottom up shade having roll-up capabilities has been disclosed in three distinct embodiments. In all three embodiments, a roller is provided around which the shade material can be wrapped and a control system for raising and lowering the top rail of the covering is positioned within the roller. In two of the embodiments, both the top and bottom rails are operated with a single control element while in the third embodiment, a control element and a pull cord are utilized to independently move the top and bottom rails. In all embodiments, the rails are moved independently of each other. It will also be appreciated the disclosures have been made by way of example and many variations such as in the panel of shade material, the cord lock, the clutch spring, and other similar components could be of other known variations providing the same functionality.

Accordingly, although the present invention has been described with a certain degree of particularity, it is understood the disclosure has been made by way of example and changes in detail or structure may be made without departing from the spirit of the invention as defined in the appended claims.

The invention claimed is:

1. A top down/bottom up covering for an architectural opening comprising in combination:

a generally cylindrical roller having at least one opening through a generally cylindrical wall thereof, a pair of end caps for supporting said roller for reversible rotation about a longitudinal axis, a reversibly rotatable drive member associated with said roller and a drive element for reversibly rotating said drive member to effect relative reversible rotation of said roller about said longitudinal axis, a flexible shade material having a top edge and a bottom edge, a top rail secured to said top edge of said shade material, a bottom rail secured to a bottom edge of said shade material, a first plurality of lift cords anchored at a top end to said roller and at a bottom end to said bottom rail, at least two reversibly rotatable spools mounted within said roller and operably connected to said drive member for selected rotation by said drive member, a second plurality of lift cords individually anchored at a top end to an associated one of said spools and at a bottom end to said top rail, whereby rotation of said roller in a first direction will cause said top rail to engage said roller and cause said flexible material to be wrapped around said roller and rotation of said roller in an opposite direction will unroll said flexible material from said roller allowing said bottom rail to drop and will thereafter allow said top rail to drop.

2. The covering of claim 1 further including a stop system in said roller for limiting rotation of said roller in said opposite direction, said stop system including a translatable member along the length of said roller which rotates in unison with said roller and an abutment for limiting translating movement of said translatable member upon a predetermined number of rotations of said roller in said opposite direction so as to prevent rotation of said roller in said opposite direction.

3. The covering of claim 2 wherein said drive member can be rotated in said opposite direction to rotate said spool in said opposite direction only when said roller is prevented from rotation in said opposite direction by said stop system.

4. The covering of claim 3 further including a slip clutch for preventing rotation of said spool by said drive member when said roller is being rotated by said drive member.

5. The covering of claim 1 further including a spring clutch for permitting rotation of said drive member by said drive element but preventing rotation of said drive member when it is not being rotated by said drive element.

6. The covering of claim 1 wherein said roller has an outwardly opening longitudinal pocket therein for releasable receipt of said top rail.

7. The covering of claim 4 wherein said slip clutch is a friction clutch.

8. The covering of claim 2 wherein said translatable member is threaded and mounted on a threaded support and wherein said threaded support is mounted on one of said end caps so as to remain stationary even during rotation of said roller and said translatable member.

9. The covering of claim 1 wherein said drive element is a cord.

10. The covering of claim 1 further including a lock element mounted in said roller for releasably fixing said roller relative to said end caps to releasably permit or prevent rotation of said roller.

11. The covering of claim 10 wherein said lock element is a pivotal lever movable between locking and unlocking positions.

12. The covering of claim 11 wherein said pivotal lever in the locking position is operatively and mechanically connected to an end cap.

13. The covering of claim 11 wherein said pivotal lever in the unlocking position is operatively and mechanically separated from the end caps.

14. The covering of claim 1 further including a threaded system for translating said spools upon relative rotation of said spools and roller.

15. The covering of claim 11 wherein said pivotal lever is pivotally mounted internally of said roller on a mounting block fixed to said roller.

16. A top down/bottom up covering for an architectural opening comprising in combination:

a generally cylindrical roller having at least one opening through a generally cylindrical wall thereof, a pair of end caps for supporting said roller for reversible rotation about a longitudinal axis, a reversibly rotatable drive member operably connected to said roller for reversible rotation of said roller about a longitudinal axis, a flexible shade material having a top edge and a bottom edge, a top rail secured to said top edge of said shade material, a bottom rail secured to said bottom edge of said shade material, a first plurality of lift cords anchored at a top end to said roller and at a bottom end to said bottom rail, a second plurality of lift cords anchored at a bottom end to said top rail, and a cord guide system within said roller to which said second plurality of lift cords are operatively connected, said cord guide system includes a plurality of cord wrap surfaces within said roller about which said second plurality of lift cords extend, whereby said first plurality of lift cords can raise or lower said bottom rail upon rotation of said roller and said second plurality of lift cords can raise or lower said top rail independently of said bottom rail.

17. The covering of claim 16 wherein said cord wrap surfaces are individually substantially vertically aligned with the location where a lift cord of said second plurality of lift cords is anchored to said top rail.

18. The covering of claim 16 wherein said second plurality of lift cords are operatively accessible to an operator of the covering.

19. The covering of claim 18 further including a pull cord accessible to an operator of the covering that is secured to said second plurality of lift cords.

20. The covering of claim 16 further including a clutch system for selectively preventing and permitting rotation of said drive member.

21. The covering of claim 19 further including a cord lock operatively engaged with said pull cord for selectively retaining said pull cord in a preselected position.

* * * * *